US008905500B2

(12) United States Patent
Larson et al.

(10) Patent No.: US 8,905,500 B2
(45) Date of Patent: Dec. 9, 2014

(54) STORAGE ASSEMBLY INCLUDES A BASE ASSEMBLY, A FIRST CABINET ASSEMBLY AND A SECOND CABINET ASSEMBLY WITH EACH SLIDABLE WITH RESPECT TO THE BASE ASSEMBLY

(75) Inventors: Alvin Larson, Jenison, MI (US); Wei Song Lee, Melaka (MY)

(73) Assignee: Steelcase Inc., Grand Rapids, MI (US)

( * ) Notice: Subject to any disclaimer, the term of this patent is extended or adjusted under 35 U.S.C. 154(b) by 233 days.

(21) Appl. No.: 13/468,703

(22) Filed: May 10, 2012

(65) Prior Publication Data

US 2012/0286631 A1 Nov. 15, 2012

Related U.S. Application Data

(60) Provisional application No. 61/486,030, filed on May 13, 2011.

(51) Int. Cl.
*A47B 88/00* (2006.01)
*A47B 87/00* (2006.01)

(52) U.S. Cl.
CPC ..... *A47B 87/00* (2013.01)
USPC ..... 312/349; 312/290; 312/139.2; 220/8

(58) Field of Classification Search
USPC ..... 312/107–108, 111, 290, 349–350, 312/139.2, 304, 301; 49/125–130; 220/8, 220/666
See application file for complete search history.

(56) References Cited

U.S. PATENT DOCUMENTS 875,734 A 1/1908 Reid
1,307,877 A 6/1919 Paul
2,614,017 A 10/1952 Mugnier
3,033,285 A * 5/1962 Banner ..... 49/425
3,100,916 A * 8/1963 McKinney ..... 49/125
3,529,382 A 9/1970 Salvarola
3,540,771 A 11/1970 Stoneburner
3,642,051 A 2/1972 Goldner
3,750,737 A 8/1973 Woodward
4,176,496 A 12/1979 Rock et al.
4,191,433 A 3/1980 Rampp et al.
4,639,970 A 2/1987 Adams
4,644,690 A * 2/1987 Caimi ..... 49/130
4,708,410 A * 11/1987 Mazaki ..... 312/138.1
4,752,106 A * 6/1988 Salvarani ..... 312/295

(Continued)

FOREIGN PATENT DOCUMENTS

EP 1982037 3/2013
EP 1982036 5/2013

*Primary Examiner* — Darnell Jayne
*Assistant Examiner* — Ryan A Doyle
(74) *Attorney, Agent, or Firm* — Price Heneveld LLP

(57) ABSTRACT

A storage assembly includes a base assembly having a base member and a back member, first and second cabinet assemblies slidable with respect to the base assembly and having top members and front members, and cooperating with the base assembly to define an interior space. The storage assembly further includes a first guide assembly including a first track member secured to the back member and roller assemblies secured to the top members, and that track within the first track member, and a second guide assembly including a second track member secured to the base member and guide members secured to the front members, and that track within the second track member, and roller assemblies secured to the front members, wherein the roller assemblies are adapted to roll along the second track member.

16 Claims, 12 Drawing Sheets

(56) References Cited

U.S. PATENT DOCUMENTS

| | | | | | |
|---|---|---|---|---|---|
| 4,753,039 | A | | 6/1988 | Jeuffray et al. | |
| 4,753,084 | A | | 6/1988 | Aoki | |
| 4,833,829 | A | * | 5/1989 | Wilson | 49/426 |
| 5,076,018 | A | | 12/1991 | Gianfranco | |
| 5,224,297 | A | | 7/1993 | Watkins | |
| 5,404,675 | A | * | 4/1995 | Schmidhauser | 49/409 |
| 5,742,979 | A | * | 4/1998 | Garcia-Hernando | 16/95 R |
| 5,839,228 | A | | 11/1998 | Duffy | |
| 5,983,568 | A | | 11/1999 | Cianetti | |
| 6,131,340 | A | * | 10/2000 | Clark et al. | 49/410 |
| 6,142,082 | A | * | 11/2000 | Burke et al. | 105/377.09 |
| 6,427,286 | B1 | | 8/2002 | Erskine | |
| 7,021,007 | B2 | | 4/2006 | Jacobs | |
| 7,299,852 | B1 | | 11/2007 | Chuang | |
| 7,441,373 | B2 | | 10/2008 | Erskine | |
| 7,458,410 | B1 | | 12/2008 | Bronner | |
| 7,472,949 | B2 | | 1/2009 | Van De Logt | |
| 7,520,090 | B2 | | 4/2009 | Gerhart | |
| 7,647,729 | B2 | | 1/2010 | Polus | |
| 2005/0000164 | A1 | * | 1/2005 | Jacobs | 49/425 |
| 2007/0033879 | A1 | * | 2/2007 | Erskine | 49/410 |
| 2007/0062122 | A1 | * | 3/2007 | Polus | 49/425 |
| 2007/0261799 | A1 | | 11/2007 | Chu | |
| 2009/0049752 | A1 | * | 2/2009 | Masuda | 49/386 |
| 2009/0151405 | A1 | * | 6/2009 | Bourgain et al. | 70/78 |
| 2010/0320887 | A1 | | 12/2010 | Bortoluzzi | |
| 2011/0266931 | A1 | * | 11/2011 | Eric et al. | 312/139.2 |

* cited by examiner

STORAGE ASSEMBLY INCLUDES A BASE ASSEMBLY, A FIRST CABINET ASSEMBLY AND A SECOND CABINET ASSEMBLY WITH EACH SLIDABLE WITH RESPECT TO THE BASE ASSEMBLY

CROSS REFERENCE TO RELATED APPLICATION

This application claims benefit of U.S. Provisional Patent Application No. 61/486,030 filed on May 13, 2011, entitled "OFFICE STORAGE ASSEMBLY," the entire disclosures of which are incorporated herein by reference.

BACKGROUND OF THE INVENTION

The present invention relates to a storage assembly, and in particular to a storage assembly that includes a pair of slidable cabinet assemblies that cooperate with a base to define an interior storage space and a reconfigurable assembly.

BRIEF SUMMARY OF THE INVENTION

One aspect of the present invention is to provide a storage assembly that comprises a base assembly including a base member and a back member extending substantially orthogonally upward from the base member, a first cabinet assembly slidable with respect to the base assembly and having a first top member and a first front member extending substantially orthogonally downward from the first top member, wherein the first cabinet member cooperates with the base assembly to define an interior storage space, and a second cabinet assembly slidable with respect to the base assembly and having a second top member and a second front member extending substantially orthogonally downward from the second top member, wherein the second cabinet member cooperates with the base assembly to define the interior storage space. The storage assembly further includes a first guide assembly including a first track member secured to the back member and including a first longitudinally extending channel and a second longitudinally extending channel laterally offset from the first channel, the first guide assembly further including a first roller assembly secured to the first top member and adapted to track within the first channel, and a second roller assembly secured to the second top member and adapted to track within the second channel. The storage assembly still further includes a second guide assembly including a second track member secured to the base member and including a third longitudinally extending channel and a fourth longitudinally extending channel laterally offset from the third channel, the second guide assembly further including a first guide member secured to the first front member and adapted to guide within the third channel, a third roller assembly secured to the first front member and adapted to roll along the second track member, a second guide member secured to the second front member and adapted to guide within the fourth channel, and a fourth roller assembly secured to the second front member and adapted to roll along the second track member, thereby slidably supporting first and second cabinet assemblies from the base assembly.

Another aspect of the present invention is to provide a storage assembly that comprises a base assembly including a base member and a back member extending substantially orthogonally upward from the base member, a first cabinet assembly slidable with respect to the base assembly and having a first top member and a first front member extending substantially orthogonally downward from the first top member, wherein the first cabinet member cooperates with the base assembly to define an interior storage space, and a second cabinet assembly slidable with respect to the base assembly and having a second top member and a second front member extending substantially orthogonally downward from the second top member, wherein the second cabinet member cooperates with the base assembly to define the interior storage space. The storage assembly further comprises a guide assembly including a track member secured to an upper edge of the back member and including a first longitudinally extending channel on the second longitudinally extending channel laterally offset from the first channel, the first and second channels cantilevered rearwardly from the back member, the first guided assembly further including a first roller assembly secured to the first top member and adapted to track within the first channel, a second roller assembly secured to the second top member and adapted to track within the second channel, thereby slidably supporting the first and second assemblies from the base assembly.

Yet another aspect of the present invention is to provide a storage assembly that comprises a base assembly including a base member and a back member extending substantially orthogonally upward from the base member, a first cabinet assembly slidable with respect to the base assembly and having a first top member and a first front member extending substantially orthogonally downward from the first top member, wherein the first cabinet member cooperates with the base assembly to define an interior storage space, and a second cabinet assembly slidable with respect to the base assembly and having a second top member and a second front member extending substantially orthogonally downward from the second top member, wherein the second cabinet member cooperates with the base assembly to define the interior storage space. The storage assembly further comprises a guide assembly including a track member secured to the base member and including a first longitudinally extending channel and a second longitudinally extending channel laterally offset from the first channel, the guide assembly further including a first guide member secured to the first front member and adapted to guide within the first channel, a first roller assembly secured to the first front member and adapted to roll along the track member, a second guide member secured to the second front member and adapted to guide within the second channel, and a second roller assembly secured to the second front member and adapted to roll along the track member, thereby slidably supporting the first and second cabinet assemblies from the base assembly.

These and other features, advantages, and objects of the present invention will be further understood and appreciated by those skilled in the art by reference to the following specification, claims, and appended drawings.

DETAILED DESCRIPTION

Figure 1A:
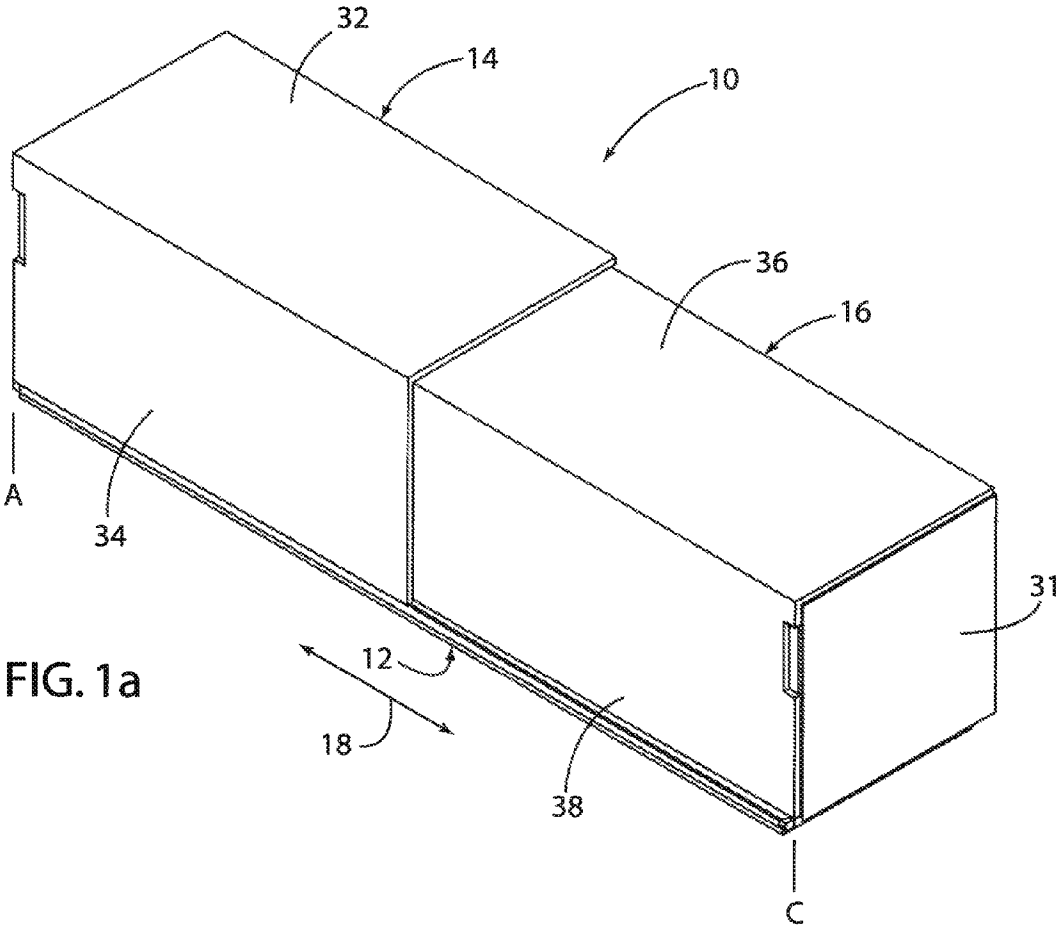
FIG. 1*a* is a perspective view of the storage assembly embodying the present invention with a pair of cabinet assemblies each in a first position.
Figure 1B:
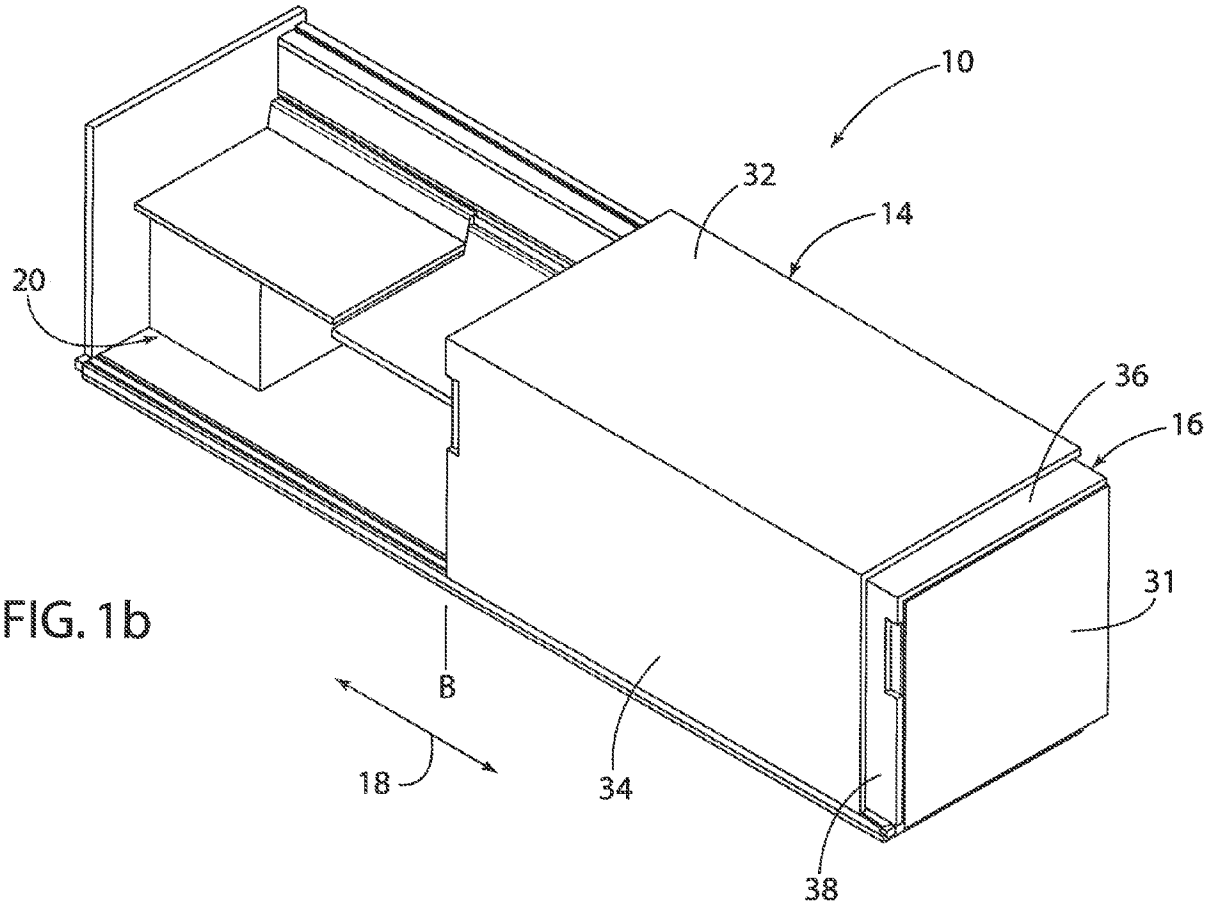
FIG. 1*b* is a perspective view of the storage assembly with a first cabinet assembly in an open position.
Figure 1C:
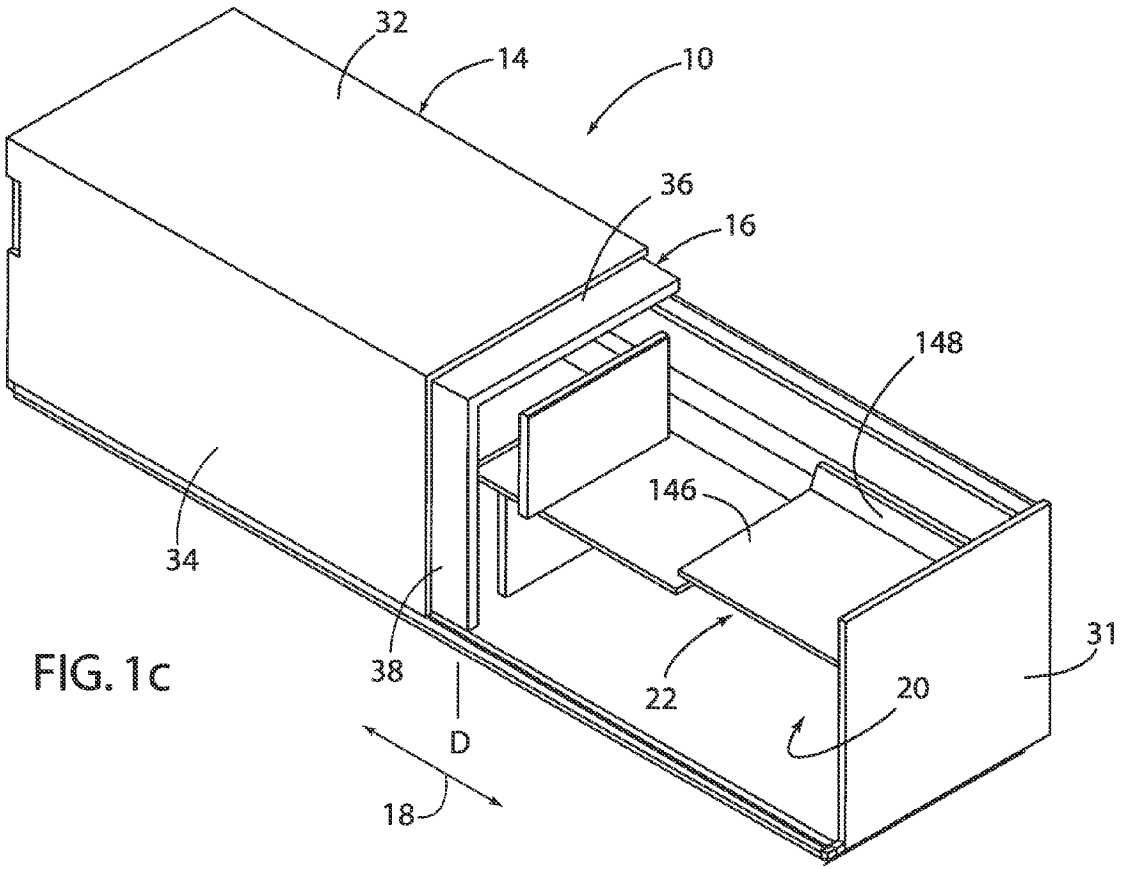
FIG. 1*c* is a perspective view of the storage assembly with a second cabinet assembly in an open position.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other characteristics relating to the embodiments disclosed herein are not to be considered as limiting, unless the claims expressly state otherwise.

The reference numeral 10 (FIG. 1*a*) generally designates a storage assembly embodying the present invention. In the illustrated example, the storage assembly 10 includes a base assembly 12, a first cabinet assembly 14, and a second cabinet assembly 16, wherein the first cabinet assembly 14 and the cabinet assembly 16 are each slidable with respect to the base assembly 12 in a direction 18. For example, the first cabinet assembly 14 is slidable from a closed position A to an open position B (FIG. 1*b*), wherein the first cabinet assembly 14 overlies the second cabinet assembly 16, while the second cabinet assembly 16 is slidable from a closed position C (FIG. 1*a*) to an open position D (FIG. 1*c*), wherein the second cabinet assembly 16 underlies the first cabinet assembly 14. The translation of the first cabinet assembly 14 and the second cabinet assembly 16 along the base assembly 12 allows for reconfiguration of the overall storage assembly 10 and access to an interior storage space 20 defined by the base assembly 12, the first cabinet assembly 14 and the second cabinet assembly 16. A shelving assembly 22 may be adjustably supported within the interior storage space 20, and is described below.

Figure 2:
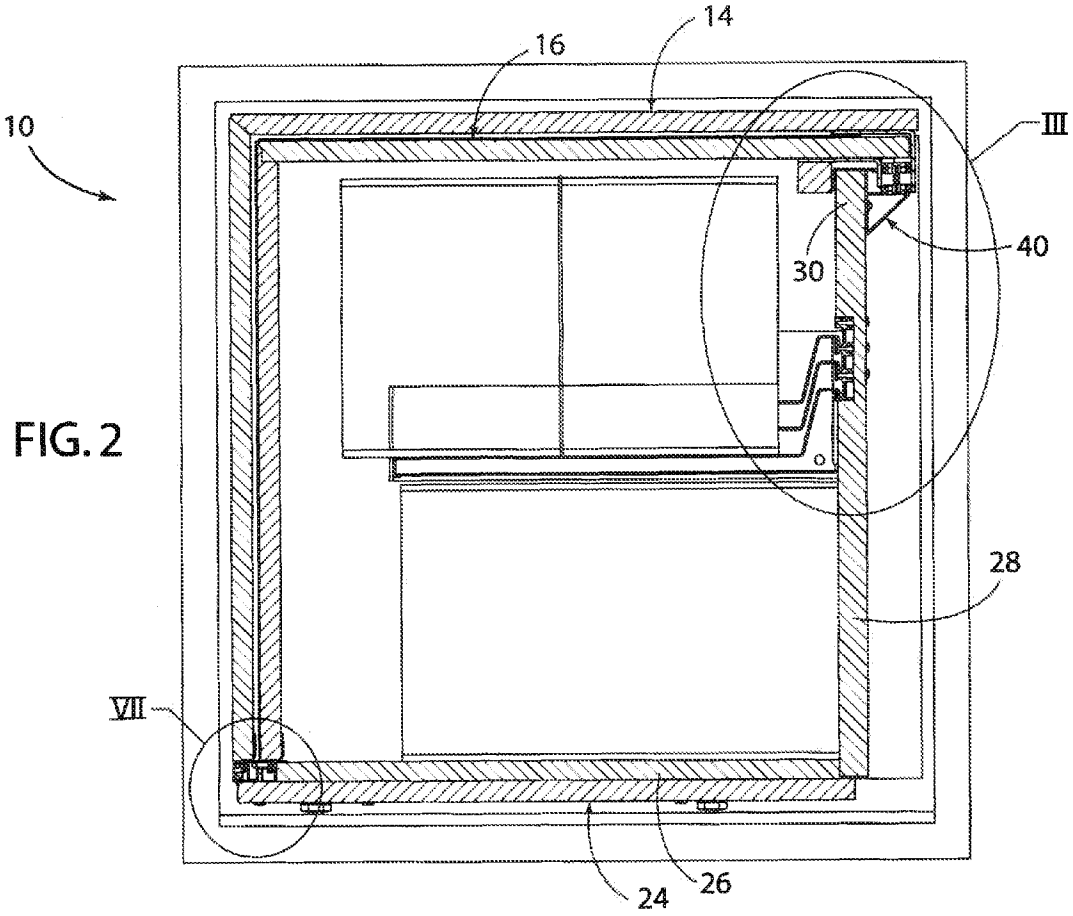
FIG. 2 is a cross-sectional end view of the storage assembly.

The base assembly 12 includes a pedestal 24, a base member or bottom wall 26 (FIG. 2), a back member or rear wall 28 which includes an upper edge 30, and side members or walls 31.

The first cabinet assembly 14 includes a horizontally extending top member or wall 32 and a vertically extending front member or wall 34 that extends orthogonally downward from a forward edge of the top member 32. The second cabinet assembly 16 includes a horizontally extending top member or wall 36 and a vertically extending front member or wall 38 that extends orthogonally downward from a forward edge of the top member 36.

Figure 3:
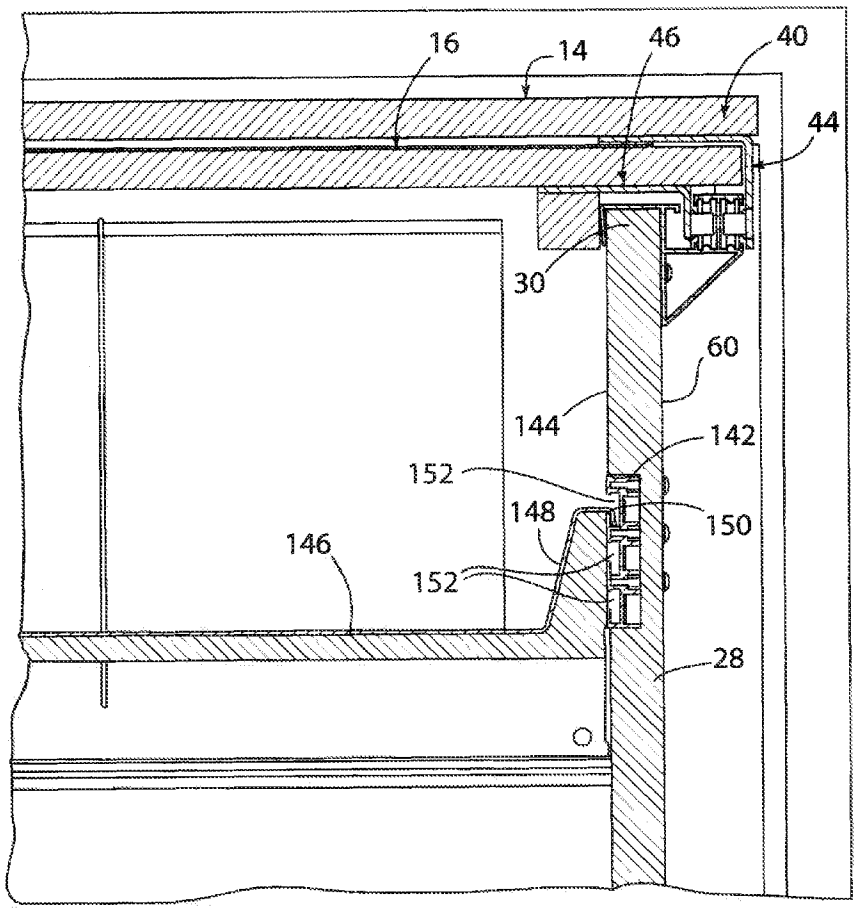
FIG. 3 is an enlarged partial end view of the storage assembly of the area III, FIG. 2.
Figure 4:
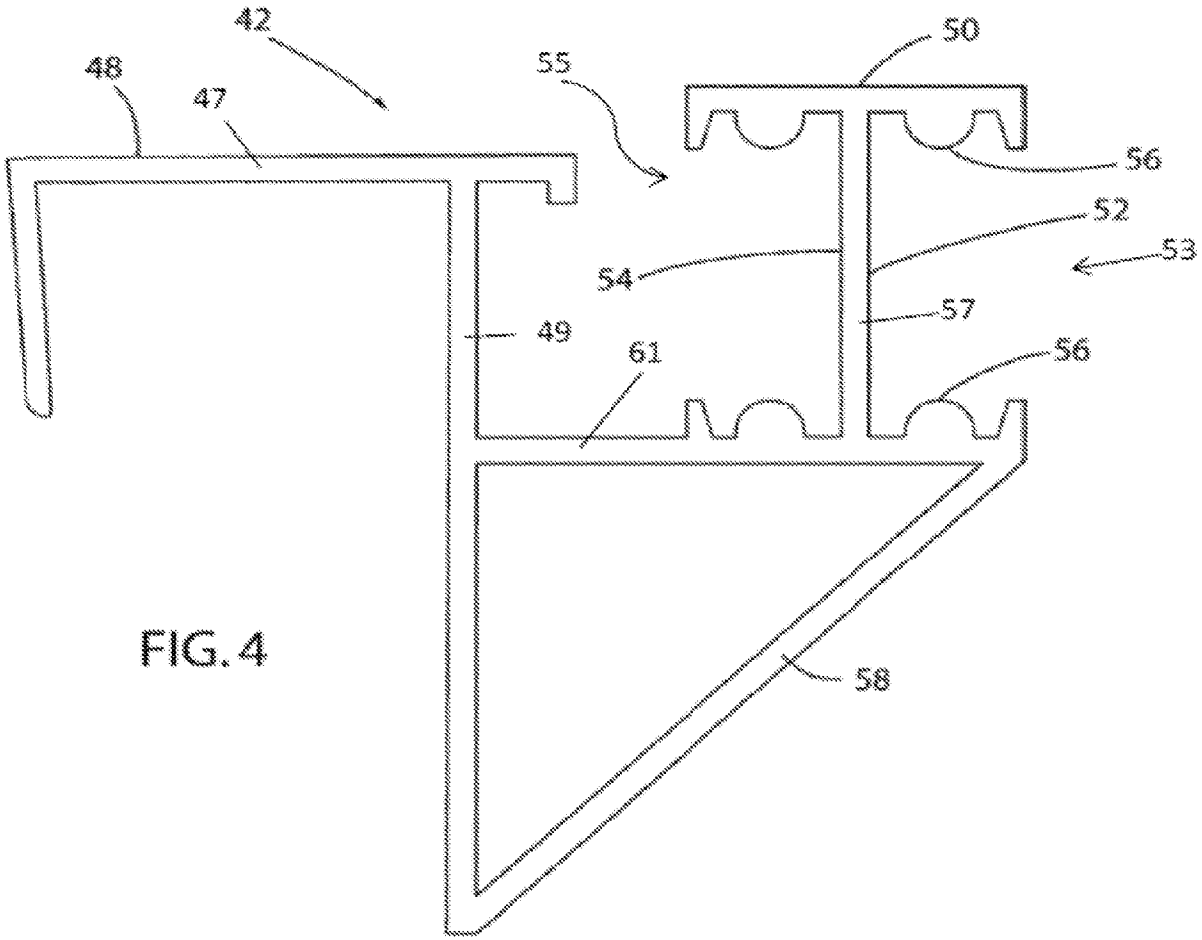
FIG. 4 is an end view of a track member of an upper guide assembly.

An upper guide assembly 40 (FIGS. 2 and 3) slidably supports the first cabinet assembly 14 and the second cabinet assembly 16 from the base assembly 12 and includes an upper track member 42 (FIG. 4), an outer roller assembly 44 and an inner roller assembly 46. The upper track member 42 includes a downwardly-opening, C-shaped, longitudinally extending attachment portion 48 receiving and secured to the upper edge 30 of the back member 28 of the base assembly 12, and including a first leg 47 and a second leg 49. The upper track member 42 further includes an I-shaped, longitudinally extending guide portion 50 defining an outer channel 52 with a first opening 53 and an inner channel 54 with a second opening 55. The outer channel 52 and the inner channel 54 each include a pair of juxtaposed track portions 56 along which the outer roller assembly 44 and inner roller assembly 46 track, as described below, and are divided by a central wall 57. The upper track member 42 further includes a triangularly-shaped, longitudinally extending structural support portion 58 that supports the distal end of the guide portion 50 from a rear surface 60 of the back member 28 and includes a rearwardly-extending cantilevered arm 61.

Figure 5:
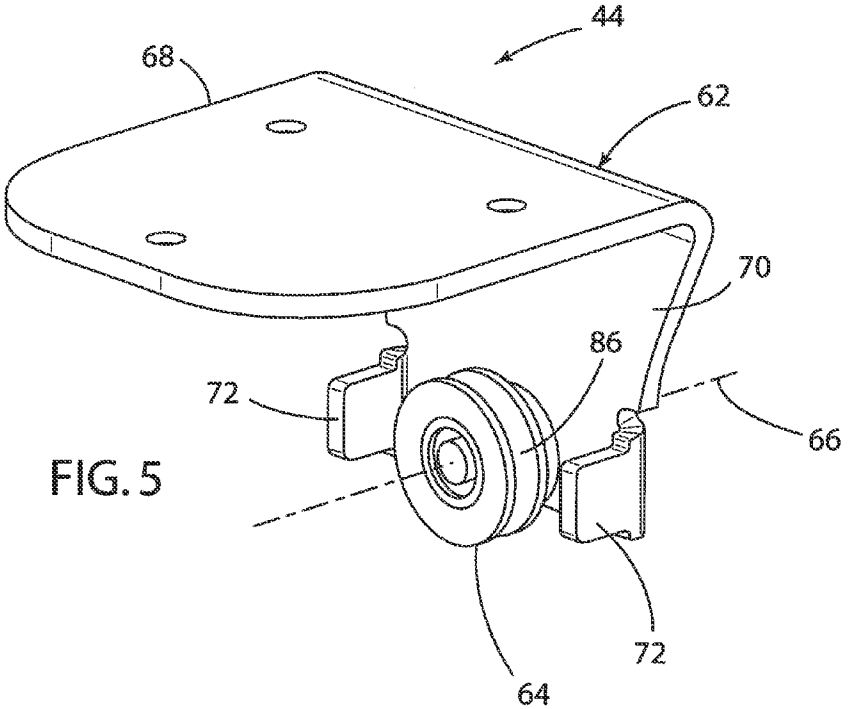
FIG. 5 is a perspective view of an outer roller assembly.
Figure 6:
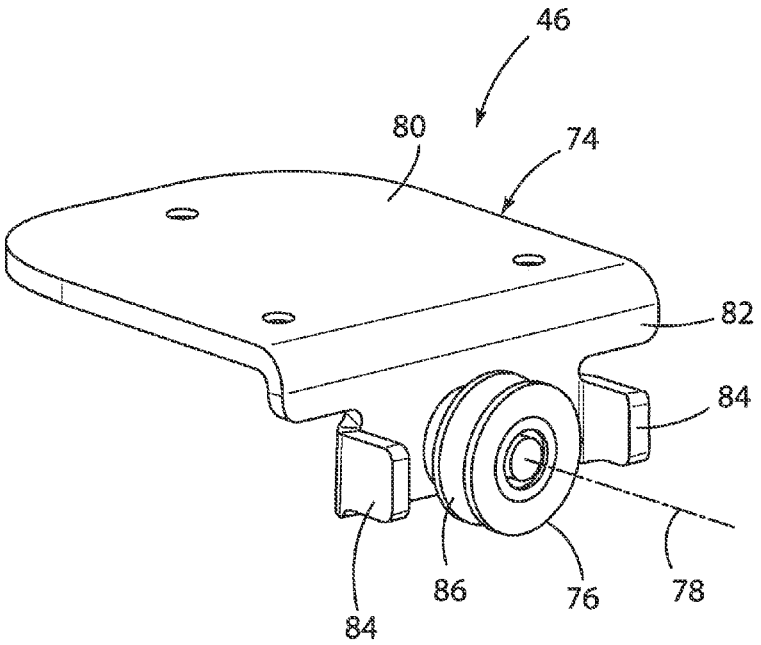
FIG. 6 is a perspective view of an inner roller assembly.

The outer roller assembly 44 (FIG. 5) includes a support bracket 62 and a roller 64 pivotally attached thereto such that the roller 64 pivots about a horizontal axis of rotation 66. The support bracket 62 includes a first portion 68 secured to an underside of the top member 32 of the first cabinet assembly 14 by a plurality of mechanical fasteners (not shown) and a second portion 70 extending orthogonally downward from the first portion 68 and to which the roller 64 is pivotally attached. The second portion 70 includes a pair of stop members 72 flanking the roller 64, the function of which is described below. The inner roller assembly 46 (FIG. 6) is similar in construction to the outer roller assembly 44 and includes a support bracket 74 and a roller 76 pivotable about a horizontal axis 78. The support bracket 74 includes a first portion 80 secured to an underside of the top member 36 of the second cabinet assembly 16 via a plurality of mechanical fasteners (not shown) and a second portion 82 extending orthogonally downward from the first portion 80 and to which the roller 76 is pivotally coupled. The second portion 82 further includes a pair of stop members 84 flanking the roller 76, the function of which is described below.

In assembly and operation, the outer roller assembly 44 and inner roller assembly 46 are positioned with respect to the upper track member 42 such that the roller 64 of the outer roller assembly 44 tracks within the outer channel 52 of the upper track member 44 and the roller 76 of the inner roller assembly 46 tracks within the inner channel 54 of the upper track member 42. Specifically, each roller 64, 76 includes a circumferentially extending recess 86 (FIGS. 5 and 6) that tracks along the track portions 56 of the respective channels 52, 54, thereby slidably supporting the top member 32 of the first cabinet assembly 14 and the top member 36 of the second cabinet assembly 16 from the back member 28 of the base assembly 12.

Figure 7:
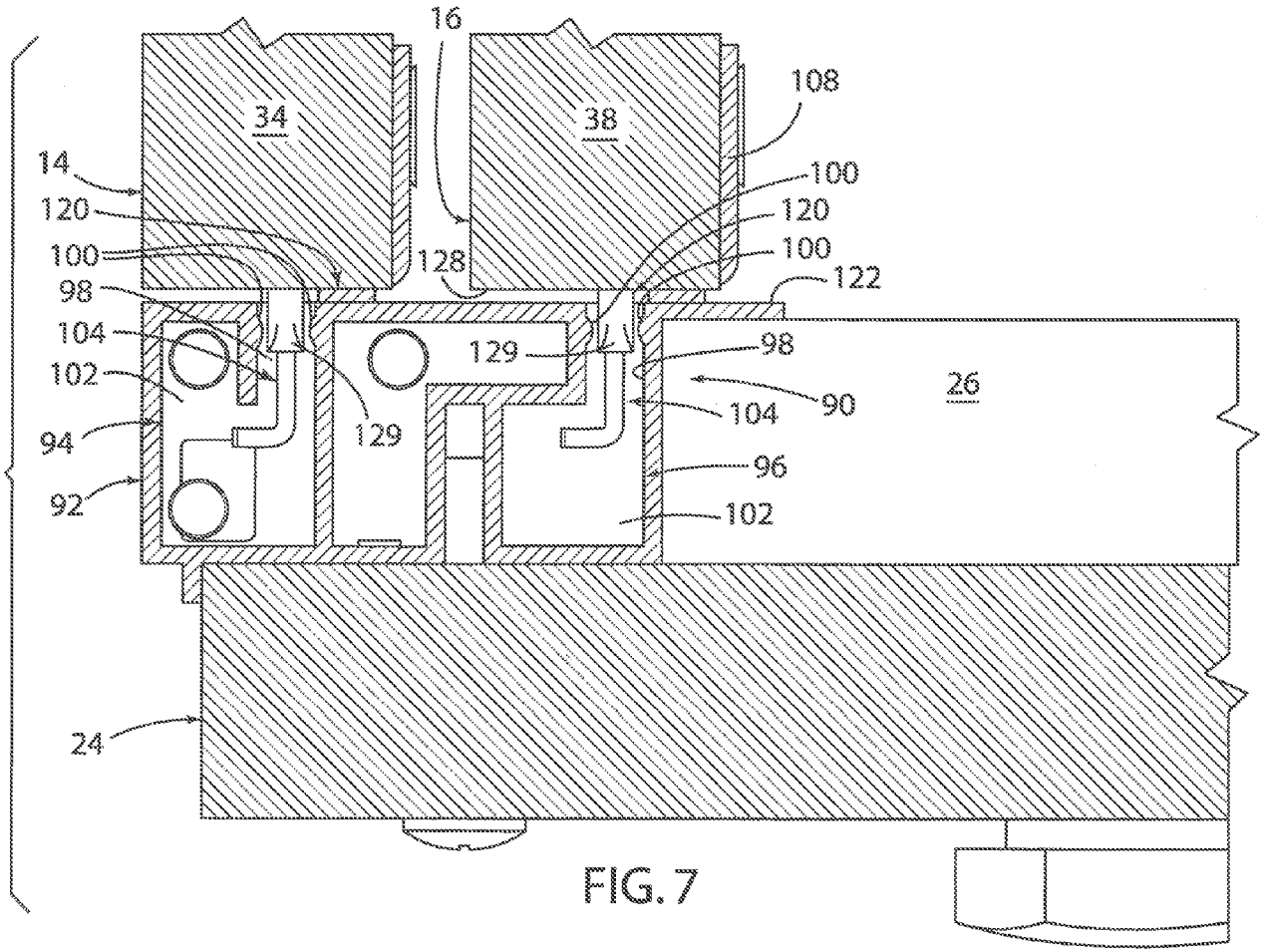
FIG. 7 is an enlarged partial end view of the storage assembly of the area VII, FIG. 2.
Figure 8:
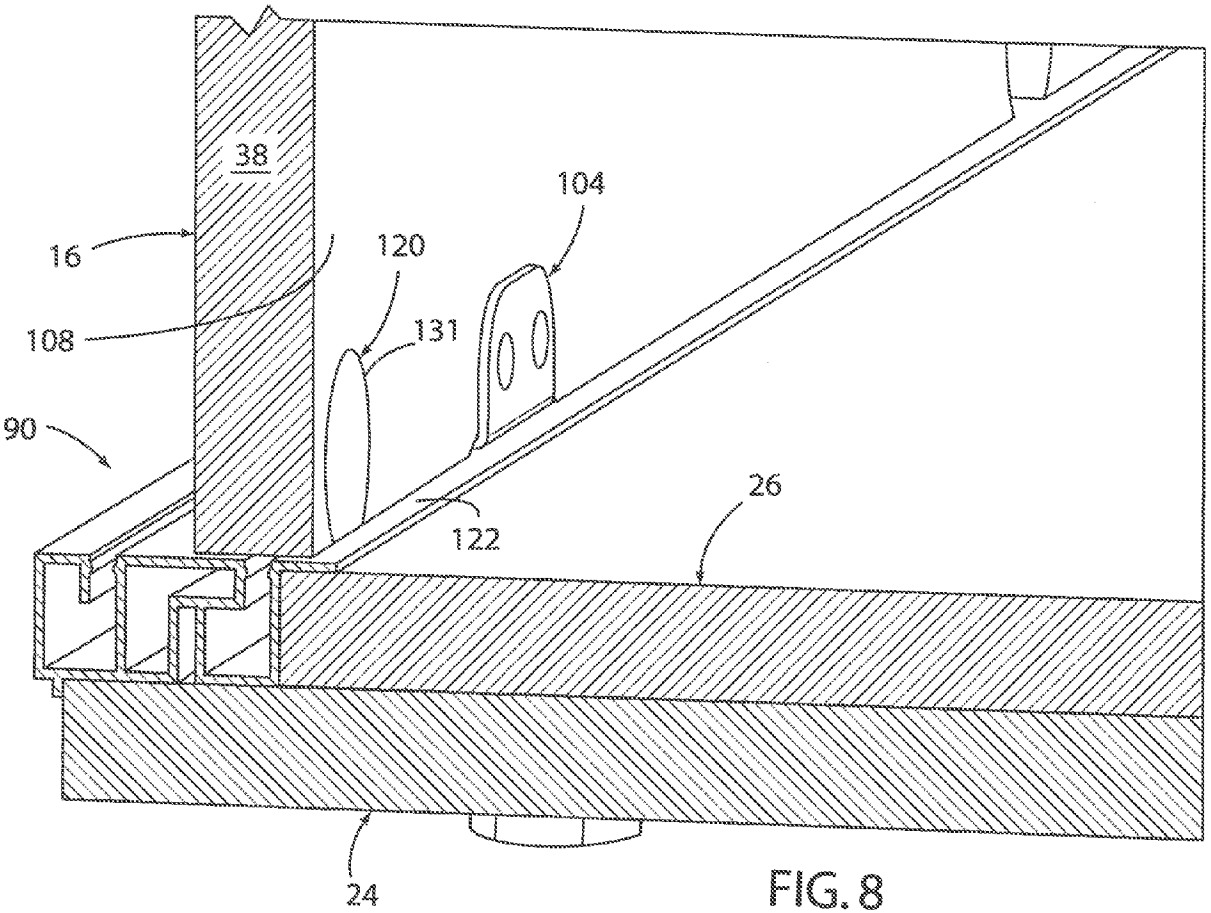
FIG. 8 is an enlarged, cross-sectional, partial perspective view of area VII, FIG. 2.
Figure 9:
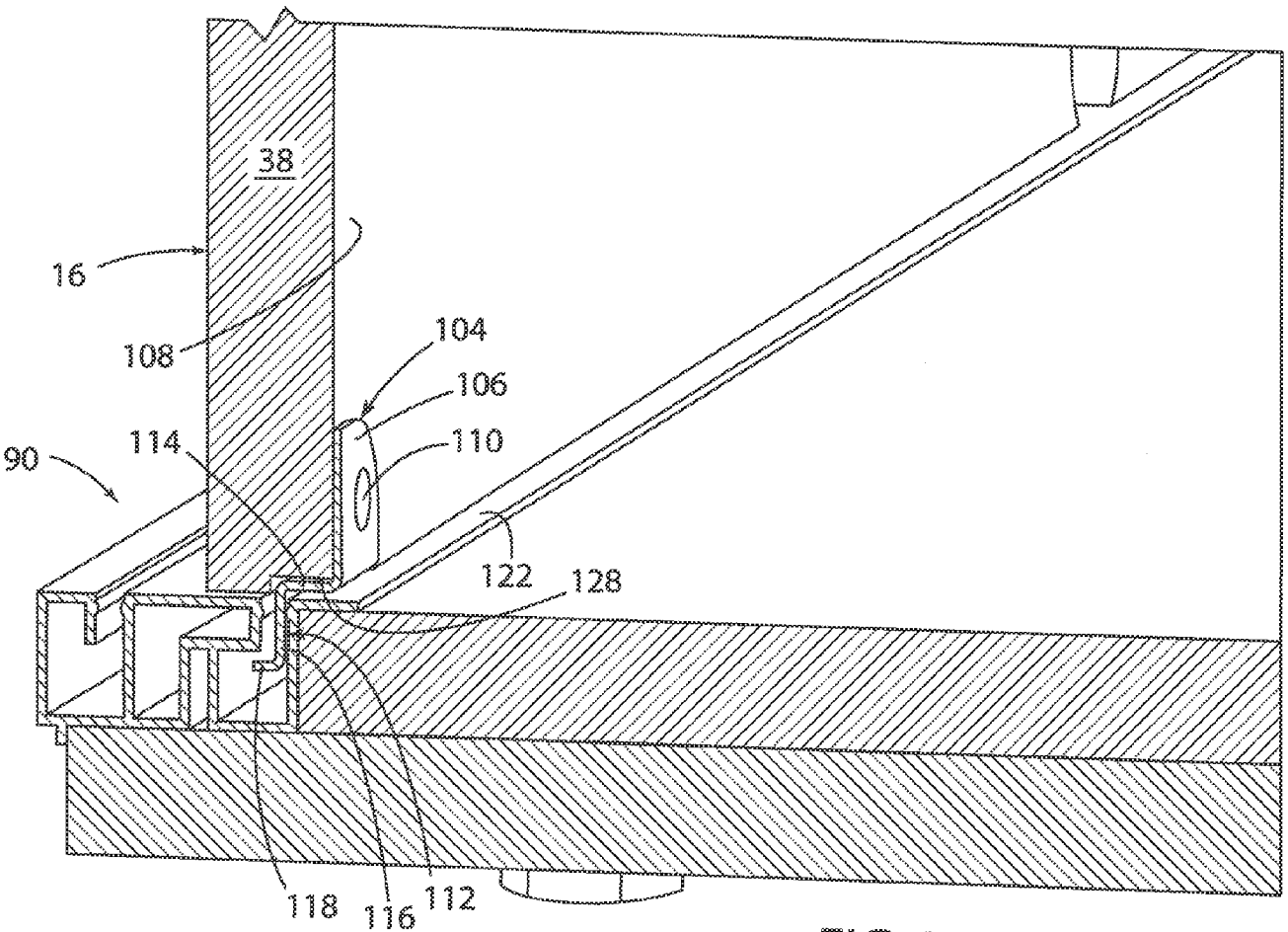
FIG. 9 is an enlarged, partial perspective view of the storage assembly.

A lower guide assembly 90 (FIGS. 7 and 8) includes a lower track member 92 secured to the pedestal 24 and base member 26 of the base assembly 12, a pair of guide members 104 coupled to the perspective front members 34, 38, and a pair of roller assemblies 120 also coupled to the respective front members 34, 38. The lower track member 92 includes a longitudinally extending outer channel 94 and a longitudinally extending inner channel 96. The outer channel 94 and the inner channel 96 each include a narrowed tracking slot 98 having a pair of longitudinally and inwardly extending juxtaposed ribs 100, and a widened interior portion 102. In the illustrated example, it is noted that the width of the tracking slot 98 is less than the width of the interior portion 102. The guide members 104 are secured to a bottom portion of the front member 34 of the first cabinet assembly 14 and the front member 38 of the second cabinet assembly 16. While the lower guide assembly 90 as it relates to the second cabinet assembly 16 is shown for illustrative purposes, it is noted that the assembly 90 as it relates to the first cabinet assembly 14 is similar in construction and configuration. Each guide member 104 (FIG. 9) includes a securement portion 106 countersunk within an inner surface 108 of the front member 38 of the second cabinet assembly 16 by a mechanical fastener 110. An S-shaped guide portion 112 of each guide member 104 includes an upper portion 114 that extends orthogonally outward from the securement portion 106 and is countersunk within a bottom edge 128 of the front member 38 (or front member 34), a mid-portion 116 that extends orthogonally downward from the upper portion 114 and through the tracking slot 98 of the inner channel 96 (or outer channel 94), and a lower portion 118 that extends orthogonally outward from the mid-portion 116 and guides within the interior portion 102 of the inner channel 96 (or outer channel 94). The ribs 100 guide the mid-portion 116 of the associated guide member 104 as the second cabinet assembly 16 is moved relative to the base assembly 12 and as the first cabinet assembly 14 is moved relative to the base assembly. The lower portion 118 of the guide member 104 prevents the guide member 104 from being removed from engagement with the lower track member 92 in a vertical direction.

Figure 10:
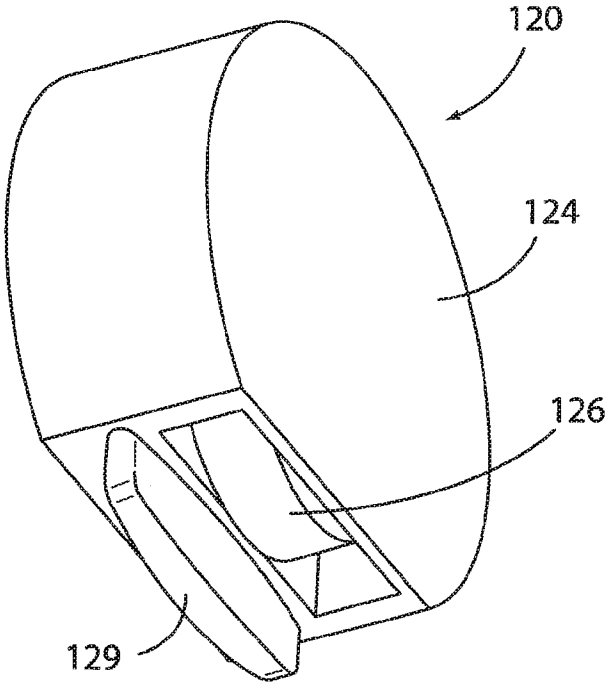
FIG. 10 is a perspective view of a roller assembly of a lower guide assembly.

The lower guide assembly 90 further includes a pair of roller assemblies 120 associated with each one of the first cabinet assembly 14 and the second cabinet assembly 16. Specifically, and by way of illustration, a roller assembly 120 is countersunk within the inner surface 108 of the front member 38 of the second cabinet assembly 16 and rolls along an upper surface 122 of the lower track member 92. As best illustrated in FIG. 10, each roller assembly 120 includes a housing 124 and a roller 126 pivotally secured within the housing 124. The housing 124 is secured within an aperture 131 within the front member 38 of the second cabinet assembly 16 such that the associated roller 126 extends downwardly below a bottom edge 128 of the front member 38 and contacts the upper surface 122 of the lower track member 92. The roller assembly 120 further includes a guide 129 that extends downwardly between the ribs 100 to prevent excessive lateral displacement as the second cabinet assembly 16 is moved relative to the base assembly 12

Figure 11:
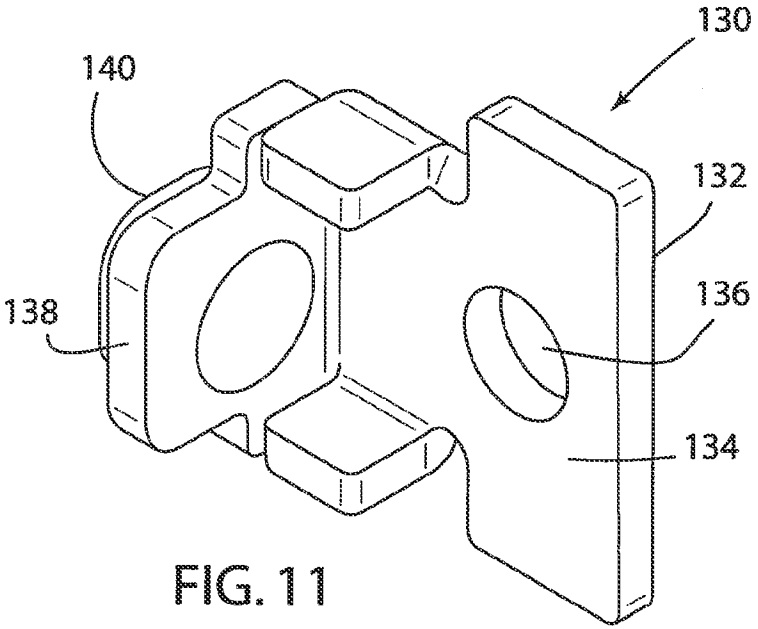
FIG. 11 is a perspective view of a bumper assembly.

As best illustrated in FIG. 11, a bumper stop assembly 130 is positionable within the outer channel 52 and inner channel 54 of the upper track member 42, and prevents a hard surface-to-surface impact between the first cabinet assembly 14 or the second cabinet assembly 16 and the base assembly 12. In the illustrated example, the bumper assembly 130 includes a support bracket 132 having a securement portion 134 that is secured within the outer track 52 or the inner track 54 by a mechanical fastener (not shown) that extends through an aperture 136. The support bracket 132 also includes a bumper mounting portion 138 that extends orthogonally from the securement portion 134 and supports an elastically resilient bumper member 140 made of rubber or other suitable material. In operation, the first cabinet assembly 14 or the second cabinet assembly 16 is prevented from a hard surface-to-surface impact with the base assembly 12 by the bumper stop assembly 130, and specifically by impact of the stop members 84 of the inner roller assembly 46 or stop member 72 of the outer roller assembly 44 with the bumper member 140 of the bumper stop assembly 130.

As best illustrated in Figs. L*c* and 3, a slat rail 142 is countersunk within a forwardly facing surface 144 of the back member 28 of the base assembly 12, and supports the shelf assembly 22 therefrom. The shelf assembly 22 includes a horizontally oriented planar shelf portion 146, and an upwardly extending support portion 148 extending upwardly from a rear edge of the shelf portion 146. An engagement hook 150 extends rearwardly from the support portion 148 and is adapted to engage select individual slats within the slat rail 142, thereby removably supporting the shelf assembly within the interior space 20 of the storage assembly 10. In the illustrated example, the slat rail 142 includes a plurality of vertically spaced slats 152, thereby allowing the shelf assembly 22 to be supported within the interior space 20 at various selected vertical positions.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A storage assembly, comprising:

a base assembly including a base member and a back member extending substantially orthogonally upward from the base member;

a first cabinet assembly slidable with respect to the base assembly and having a first top member and a first front member extending substantially orthogonally downward from the first top member, wherein the first cabinet assembly cooperates with the base assembly to define an interior storage space;

a second cabinet assembly slidable with respect to the base assembly and having a second top member and a second front member extending substantially orthogonally downward from the second top member, wherein the second cabinet assembly cooperates with the base assembly to define the interior storage space;

a first guide assembly including a first track member having a downwardly C-shaped attachment portion secured to an upper edge of the back member and including a first longitudinally extending channel and a second longitudinally extending channel laterally offset from the first channel, wherein the first channel and the second channel are disposed on a cantilevered arm from the downwardly C-shaped attachment portion, the first guide assembly further including a first roller assembly secured to the first top member and having a first roller with a horizontal axis of rotation adapted to track within the first channel, and a second roller assembly secured to the second top member and having a second roller with a horizontal axis of rotation adapted to track within the second channel, thereby slidably supporting the first and second cabinet assemblies from the base assembly; and a second guide assembly including a second track member secured to the base member and including a third longitudinally extending channel and a fourth longitudinally extending channel laterally offset from the third channel, the second guide assembly further including a first guide member secured to the first front member and adapted to guide within the third channel, a third roller assembly secured to the first front member and adapted to roll along the second track member, a second guide member secured to the second front member and adapted to guide within the fourth channel, and a fourth roller assembly secured to the second front member and adapted to roll along the second track member, thereby slidably supporting the first and second cabinet assemblies from the base assembly; and wherein the first and second channels of the first track member are cantilevered rearward of the back member, with the cantilevered arm extending from the back member in a direction opposite the first front member and the second front member.

2. The storage assembly of claim 1, wherein the first cabinet assembly tracks over the second cabinet assembly.

3. The storage assembly of claim 1, wherein the first track member further comprises a structural support portion extending diagonally from the cantilevered arm to the back member.

4. The storage assembly of claim 1, wherein the third roller assembly and the fourth roller assembly each include a roller having a horizontally oriented axis of rotation.

5. The storage assembly of claim 4, wherein the third and fourth channels of the second track member each include a longitudinally extending tracking slot having a first width and an interior portion having a second width that is greater than the first width, and wherein the first guide member extends through the tracking slot into the interior portion of the third channel and the second guide member extends through the tracking slot and into the interior portion of the fourth channel such that the guide members cannot be directly vertically removed from engagement with the second track member.

6. The storage assembly of claim 1, wherein the third roller assembly is at least partially countersunk within a vertical surface of the first front member, and wherein the fourth roller assembly is at least partially countersunk within a vertical surface of the second front member.

7. The storage assembly of claim 6, wherein the third roller assembly is countersunk within the vertical surface of the first front member that faces the interior space, and wherein the fourth roller assembly is countersunk within the vertical surface of the second front member that faces the interior space.

8. The storage assembly of claim 6, wherein the third and fourth rollers roll along a top surface of the second track member.

9. A storage assembly, comprising:

a base assembly including a base member and a back member extending substantially orthogonally upward from the base member;

a first cabinet assembly slidable with respect to the base assembly and having a first top member and a first front member extending substantially orthogonally downward from the first top member, wherein the first cabinet assembly cooperates with the base assembly to define an interior storage space;

a second cabinet assembly slidable with respect to the base assembly and having a second top member and a second front member extending substantially orthogonally downward from the second top member, wherein the second cabinet assembly cooperates with the base assembly to define the interior storage space; and a first guide assembly including a first track member secured to an upper edge of the back member and including a first longitudinally extending channel and a second longitudinally extending channel laterally offset from the first channel, the first and second channels cantilevered rearwardly from the back member and disposed on an opposite side of the back member than the first front member and the second front member, the first guide assembly further including a first roller assembly secured to the first top member and having a first roller adapted to track within the first channel, and a second roller assembly secured to the second top member and having a second roller adapted to track within the second channel, wherein the first roller and the second roller each have a horizontal axis of rotation thereby slidably supporting the first and second cabinet assemblies from the base assembly.

10. The storage assembly of claim 9, wherein the first cabinet assembly tracks over the second cabinet assembly.

11. The storage assembly of claim 9, wherein a cantilevered arm supports a vertical load applied through the first and second rollers, to slidably support the weight of the first cabinet assembly and the second cabinet assembly.

12. The storage assembly of claim 11, further comprising:

a structural support portion extending diagonally from the cantilevered arm to the back member, wherein the structural support portion aids in supporting the vertical load applied to the cantilevered arm through the first and second rollers.

13. A storage assembly, comprising:

a base assembly including a base member and a back member extending substantially orthogonally upward from the base member;

a first cabinet assembly slidable with respect to the base assembly and having a first top member and a first front member extending substantially orthogonally downward from the first top member, wherein the first cabinet assembly cooperates with the base assembly to define an interior storage space;

a second cabinet assembly slidable with respect to the base assembly and having a second top member and a second front member extending substantially orthogonally downward from the second top member, wherein the second cabinet assembly cooperates with the base assembly to define the interior storage space; and a first guide assembly including a first track member having an attachment portion with a first leg secured to an upper edge of the back member and a second leg extending substantially orthogonally from the first leg, and including a cantilevered arm extending from the second leg, the cantilevered arm supporting a first longitudinally extending channel and a second longitudinally extending channel, wherein the second channel is laterally offset from the first channel, the first guide assembly further including a first roller assembly secured to the first top member and having a first roller with a horizontal axis of rotation adapted to roll along the first channel and a second roller assembly secured to the second top member and having a second roller with a horizontal axis of rotation adapted to roll along the second channel, the first guide assembly thereby slidably supporting the first and second cabinet assemblies from the base assembly; and wherein the cantilevered arm extends rearwardly from the back member, extending from the back member in a direction away from the first front member and the second front member.

14. The storage assembly of claim 13, wherein the first cabinet assembly tracks over the second cabinet assembly.

15. The storage assembly of claim 13, further comprising:

a first opening in the first channel to receive the first roller; and a second opening in the second channel to receive the second roller, wherein the second opening receives the second roller from an opposite direction than the first opening receives the first roller.

16. The storage assembly of claim 13, wherein the first channel and the second channel are mechanically separated by a central wall extending generally orthogonally from the cantilevered arm to at least partially define the first channel and the second channel, wherein the central wall prevents the first roller assembly from entering the second channel and prevents the second roller assembly from entering the first channel.

* * * * *